US009159481B2

(12) United States Patent
May

(10) Patent No.: US 9,159,481 B2
(45) Date of Patent: Oct. 13, 2015

(54) NON-CONTACT TORQUE SENSOR WITH PERMANENT SHAFT MAGNETIZATION

(75) Inventor: Lutz May, Berg (DE)

(73) Assignee: PolyResearch AG, Chur (CH)

( * ) Notice: Subject to any disclaimer, the term of this patent is extended or adjusted under 35 U.S.C. 154(b) by 189 days.

(21) Appl. No.: 13/819,570

(22) PCT Filed: Sep. 21, 2010

(86) PCT No.: PCT/EP2010/063892

§ 371 (c)(1),
(2), (4) Date: Apr. 18, 2013

(87) PCT Pub. No.: WO2012/037969

PCT Pub. Date: Mar. 29, 2012

(65) Prior Publication Data

US 2013/0207757 A1 Aug. 15, 2013

(51) Int. Cl.
*H01H 47/00* (2006.01)
*H01F 13/00* (2006.01)

(52) U.S. Cl.
CPC ..... *H01F 13/003* (2013.01)

(58) Field of Classification Search
CPC ..... H01F 13/003
USPC ..... 361/139, 143, 147, 155, 156
See application file for complete search history.

(56) References Cited

U.S. PATENT DOCUMENTS

| | | | | |
|---|---|---|---|---|
| 3,204,224 | A | 8/1965 | Etal | |
| 3,221,311 | A | 11/1965 | Wollman | |
| 6,542,348 | B1 | 4/2003 | Stupak, Jr. | |
| 2004/0095116 | A1 * | 5/2004 | Kernahan et al. | 323/282 |
| 2009/0295778 | A1 * | 12/2009 | Maehara et al. | 345/213 |

FOREIGN PATENT DOCUMENTS

| | | |
|---|---|---|
| GB | 917814 | 2/1963 |
| GB | 1 481 190 | 7/1977 |

* cited by examiner

*Primary Examiner* — Thienvu Tran
*Assistant Examiner* — Tien Mai
(74) *Attorney, Agent, or Firm* — Fay Kaplun & Marcin, LLP

(57) ABSTRACT

A device for magnetizing an object includes first and second electrode for contacting the object to be magnetized as well as a current generator. The generator is configured to apply a current having a raising current slope and a falling current slope. The falling current slope is steeper than the raising current slope.

11 Claims, 3 Drawing Sheets

NON-CONTACT TORQUE SENSOR WITH PERMANENT SHAFT MAGNETIZATION

FIELD OF THE INVENTION

The present invention relates to a non-contact torque sensor that can measure the applied torque forces onto a symmetrically or non-symmetrically shaped transmission shaft (solid or tube).

BACKGROUND OF THE INVENTION

Force measuring is important for many industrial applications, in particular for arrangements being dynamically impacted by a force. Applied forces may be pressuring forces as well as moments like torque and bending impact. An exemplary application for torque is a shaft for a vehicle being arranged between a motor and e.g. a wheel. For determining a torque in the shaft, a particular element needs to be mounted to the shaft. Mounting elements to a shaft may influence the movement of the shaft.

SUMMARY OF THE INVENTION

There may be a need for producing a non-contact torque sensor that can measure the applied torque forces onto a symmetrically or non-symmetrically shaped transmission shaft (solid or tube).

The object is solved by the subject matter of the independent claims, further embodiments are incorporated in the dependent claims.

According to an exemplary embodiment of the invention, there is provided a device for magnetizing an object, the device comprising a first electrode and a second electrode for contacting the object to be magnetized, and a current generator being adapted to apply a current having a raising current slope and a falling current slope, wherein the falling current slope is steeper than the raising current slope. Such a device and corresponding method is distributed by PolyResearch under 'Einstein'.

Thus, a device for magnetizing an object can be provided, which is capable of generating a particular distribution of a magnetic field and magnetic field lines within the object to be magnetized. The particular distribution may allow providing an external magnetic field at the object, which external field depends on the forces applied to the object, e.g. torque. The raising slope and the falling slope provide particular currents for magnetization, wherein the distribution of the magnetization may depend on the steepness of the raising and falling slope. It should be noted that the electrodes may be designed as contact electrodes or as wireless electrodes. The latter do not require an electric contact, but may use e.g. inductive coupling or the like.

According to an exemplary embodiment of the invention, there is provided a device for magnetizing an object, wherein the current generator comprises a current supply having a first and second terminal, a first switch having a first and second terminal, an inductance having a first and second terminal, a resistance having first and second terminal, a switch control, wherein the first terminal of the current supply is connected to the second electrode, the second terminal of the current supply is connected to the first terminal of the first switch, the second terminal of the first switch is connected to the first terminal of the inductance, and the second terminal of the inductance is connected to the first terminal of the resistance, the second terminal of the resistance is connected to the first electrode, wherein the switch control is adapted to close the first switch for starting a raising current slope.

Thus, a particular device can be provided, which allows providing the required energy and the required slope gradient such that the falling slope is steeper than the raising slope. The current generator comprises a first switch which allows controlling the current so as to maintain the current within the required ranges for the raising slope. The inductance and the resistance determine the gradient of the raising slope.

According to an exemplary embodiment of the invention, there is provided a device for magnetizing an object, wherein the current generator comprises a current supply having a first and second terminal, a first switch having a first and second terminal, an inductance having a first and second terminal, a switch control, wherein the first terminal of the current supply is connected to the second electrode, the second terminal of the current supply is connected to the first terminal of the first switch, the second terminal of the first switch is connected to the first terminal of the inductance, and the second terminal of the inductance is connected to the first electrode, wherein the object to be magnetized operates as a resistance when being connected to the first and second electrode, wherein the switch control is adapted to close the first switch for starting a raising current slope.

Thus, a particular device can be provided, which allows providing the required energy and the required slope gradient such that the falling slope is steeper than the raising slope. The current generator comprises a first switch which allows controlling the current so as to maintain the current within the required ranges for the raising slope. The inductance and the resistivity of the object to me magnetized determine the gradient of the raising slope.

According to an exemplary embodiment of the invention, there is provided a device for magnetizing an object, wherein the second electrode is connected to ground.

Thus, all other devices being connected to the second electrode may be also directly connected to ground.

According to an exemplary embodiment of the invention, there is provided a device for magnetizing an object, wherein the resistance operates as a shunt, which shunt provides a measurement signal to the switch control, which measurement signal serves as a base for controlling the switch or switches.

Thus, the current slope can be measured, in particular the current of the raising current slope. The measured current may be used to determine the suitable point of time to terminate the raising slope and to succeed with the falling slope.

According to an exemplary embodiment of the invention, there is provided a device for magnetizing an object, further comprising a second switch having a first and a second terminal, wherein the first terminal of the second switch is connected to a branch between the second terminal of the first switch and the first electrode and the second terminal of the second switch is connected to the second electrode, wherein the switch control is adapted to close the second switch when opening the second switch at an end of the raising current slope.

Thus, the second switch may be used to terminate the raising slope, in particular when the gradient of the raising slope decreases or deviates from the required linear by a predetermined threshold.

According to an exemplary embodiment of the invention, there is provided a device for magnetizing an object, further comprising a charging capacity having a first and a second terminal, wherein the first terminal of the charging capacity is connected to the first terminal of the first switch and the second terminal of the charging capacity is connected to the second electrode.

Thus, the energy for feeding the raising slope of the magnetizing current may be stored in a capacity. This avoids a limitation of power of power sources being only grid connected without storing capabilities.

According to an exemplary embodiment of the invention, there is provided a method for magnetizing an object, the method comprising applying a magnetizing current from a first electrode having a first section of the object to be magnetized to a second electrode having a second section of the object to be magnetized, wherein the second section is remote from the first section, wherein the magnetizing current has a rising slope and a successive falling slope, wherein the falling slope is steeper than the raising slope.

According to an exemplary embodiment of the invention, there is provided a method for magnetizing an object, wherein the rising slope is of a substantially linear gradient.

Thus, the magnetizing can be made widely uniform, as the magnetizing depends on the gradient of the current. Therefore, the reproducibility can be improved by keeping the raising slope at a fixed, i.e. linear gradient.

According to an exemplary embodiment of the invention, there is provided a method for magnetizing an object, wherein the rising slope starts from substantially zero and substantially rises linearly, and the falling slope immediately succeeds and ends at substantially zero.

Thus, particular effects at the beginning of the magnetizing process and at the end of the magnetizing process may be avoided, as the current starts and terminates at zero.

According to an exemplary embodiment of the invention, there is provided a method for magnetizing an object, wherein the time period of the rising slope is more than 1000 times longer than the time period of the falling slope.

Thus, the quality and reproducibility of the magnetized object can be obtained in a good condition. The raising slope may take a time frame of about one to several milliseconds, wherein the falling slope may take a time frame of about one or less microseconds. The respective time frames are taken from the time, where the respective slope is within a predetermined range, e.g. a predetermined gradient. The transit time between the time frame of the raising edge and the time frame of the falling edge should be kept short.

According to an exemplary embodiment of the invention, there is provided a method for magnetizing an object, wherein the rising slope is positive and the falling slope is negative.

According to an exemplary embodiment of the invention, there is provided a method for magnetizing an object, wherein applying a respective electrode includes electrically contacting the respective electrode to the object to be magnetized.

According to an exemplary embodiment of the invention, there is provided a magnetized object, which magnetized object is obtained by applying a magnetizing current from a first contacting region to a second contacting region, wherein the magnetizing current has a rising slope and a successive falling slope, wherein the falling slope is steeper than the rising slope.

According to an exemplary embodiment of the invention, there is provided a magnetized object, wherein the magnetized object is an elongated object, wherein the first contacting region and the second contacting region are spaced apart in a longitudinal direction.

According to an exemplary embodiment of the invention, there is provided a use of a magnetized object as described above for determining a torque applied to the magnetized object by measuring the resulting external magnetic field of the magnetized object.

The present invention provides a non-contact torque sensor that can measure the applied torque forces onto a transmission shaft (solid or tube). The key features of the torque sensor are the use under harsh operating conditions and where fast signal changes need to be measured accurately. Additional sensor features are the capability of compensating the changes in operating temperature range, of being insensitive to mechanical vibrations and intense mechanical shocks, to be insensitive to the presence or to the changes of light, humidity, dust, air or fluid pressure, to have a very small space requirement, being easy to apply in already existing applications (can be retrofitted), has very short manufacturing cycles as there are no mechanical changes required on the test object. Further, no mechanical changes are needed at the sensor object (transmission shaft, for example). It can tolerate some axial movements of the sensing system in relation to the sensor object and has a very high signal bandwidth of greater than 500,000 samples per second. The non-contact torque sensor has no limitations in relation to the sensor object rotation. It may be applied to objects that have some ferromagnetic properties (relaxed alloy specification). The sensor objects are permanent magnetized (very durable), and the shaft processing is done using a proprietary electrical signal. The shaft processing results in a unique shaft magnetization covering most of the shaft cross section. The sensor signal quality is superior to alternative magnetic shaft processing and the processing and measurement signal allow real-time diagnostics and compensations. The shaft processing equipment is very small/light and inexpensive.

Even if not explicitly mentioned, it should be noted that the above features also may be combined. The combination of particular features may lead to synergetic effects extending over the sum of the single features.

The aspects defined above and further aspects, features and advantages of the present invention can also be derived from the examples of embodiments to be described hereinafter and are explained with reference to examples of embodiments. The invention will be described in more detail hereinafter with reference to examples.

BRIEF DESCRIPTION OF THE DRAWINGS

In the following for further illustration and to provide a better understanding of the present invention exemplary embodiments are described in more details with reference to the enclosed drawings, in which.

The illustration in the drawings is schematically only and not scale. It is noted in different figures, similar elements are provided with the same reference signs.

DETAILED DESCRIPTION OF EXEMPLARY EMBODIMENTS OF THE INVENTION

Figure 1:
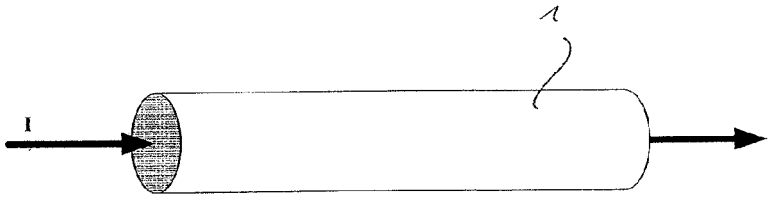
FIG. 1 illustrates a sensing object, e.g. a transmission shaft according to an exemplary embodiment of the invention.

Differences to other known, magnetic principle based Torque Sensor Technologies (other technologies cannot do) are a unique manufacturing process, as no shaft pre-processing (degaussing) or post-processing (CX) is required. This leads to a up to factor 10 shorter manufacturing cycle. Further, fewer mechanical and electrical components are required for the shaft processing (lower cost, lower failure rate during processing). The unique manufacturing process has no "contact" wear-out of the required processing equipment and no burn-out-effect of the electrical contacts needed by the actual shaft processing. The shaft encoding-signal allows real-time shaft diagnostic. Unlike other processing methods, critical processing parameters can be measured in real-time and the diagnostic measurement results are used to eliminate processing tolerances. The invention requires minimal or no post-shaft treatment after the shaft has been magnetically encoded. The torque sensitivity is increased as the entire shaft cross-section will be magnetically encoded (higher gain than any other magnetic torque sensing technology). There is only a limited or no-signal aging, wherein alternative magnetic sensing technologies (like from MDI, FAST, NCTE) will lose some of their measurement performances when the emanating magnetic field is reaching and exceeding a certain absolute magnetic field strength. When reaching approximately 0.03 mT (30 Gauss) (when using industrial Ferro magnetic steels) then the signal gain value of the sensor object will drop permanently to a lower level. This effect is called "signal aging". The inventive torque sensor technology has very limited or no signal aging. The ferro-magnetic "mass" of the sensor object is actually protecting the magnetised area of the sensor object. There is a capability of cancelling-out the unwanted effects of material related torque-signal hysteresis. Within a few percent the inventive encoding allows to compensate the unwanted measurement hysteresis effects caused shaft material related hysteresis. There is no other post-processing of the sensor device needed, leading to lower cost and faster manufacturing cycle. The invention does not rely on shaft material that has been specially "selected" ferromagnetic alloy parameters and allows using ferromagnetic shaft material (of the same type) with relative wide alloy tolerances. This leads to very small and light magnetic processing equipment (fits easily in a briefcase). Alternative magnetic torque sensing technologies require large and heavy processing equipment (example: around 5 kg to 8 kg for this processing equipment versus 40 kg to 100 kg and more for alternative magnetic sensing technology processing equipment). The smaller sensor design leads to limited or no wastage of axial spacing on the sensor object (very short sensing region). Alternative magnetic sensing technologies that rely on the permanent magnetisation of the sensor object have "wastage" areas of around 5 mm or more in axial direction on each side of the sensor object (shaft). For example: To produce a sensing region on the sensor object of a 20 mm lengths, requires a total shaft length of 30 mm: 20 mm for the actual sensor plus 2 times 5 mm wastage area. The invention provides for a very high signal bandwidth of >150,000 Hz analogue (which is more than 500,000 samples per second. This unusual high signal bandwidth is limited only by the used magnetic sensor elements and by the used sensor electronics. However, there are several magnetic sensor components and electronic data acquisition designs available that can handle such high data rates.

Alternative magnetic torque sensor designs rely on very tight tolerances of the shaft material (the test object), on a near "perfect" execution of a partially manual operated manufacturing process, and on a well controlled tolerances of the actual sensor frame design. These "restrictions" limit the usage of traditional non-contact, magnetic principle based mechanical force sensors as they will be still too expensive for a true "volume" applications. The here described inventive sensor design (including the required manufacturing process) combines the benefits of: a robust sensor design, low manufacturing costs, easy to manage and easy to control manufacturing process, and that provides very repeatable results.

When torque forces are applied to the sensor object (permanently magnetised object, like transmission shaft) the magnetic flux profile around the sensor object will change in relation to the applied torque forces. The changes of the magnetic-flux signals are strong enough to be detected and to be measured by a wide range of commercially available magnetic field sensors, including but not limited to Hall effect sensors (e.g. the analogue version), MR and GMR, or Flux Gate. The adjustable performance of the permanent magnetic processing that will be applied to the sensor object defines the absolute magnetic-flux signal strength (some limits do apply) that can be detected by the sensing module near the surface of the sensor object. The stronger the reaction of the emanating magnetic flux lines (when applying torque forces to the sensor object) the easier it will be to measure the magnetic signals and by the magnetic sensing module. Therefore the earth-magnetic field has only a limited or no effect on the actual torque measurement. That means this sensor system can be used in a non-differential sensing mode. However, it is always advisable to use a differential measurement mode to compensate for a wide range of unwanted environmental effects.

FIG. 1 illustrates a sensing object, e.g. a transmission shaft according to an exemplary embodiment of the invention. The permanent magnetisation of a ferro magnetic object can take place at almost any location of the sensing object (transmission shaft, for example). When choosing the optimal sensing location it is important to ensure that the to-be-measured torque forces are passing through the location where the inventive sensor should be placed. When aiming for a torque sensor design at a power transmission shaft 1 (like in a gearbox, for example) then it is advisable to find a location for the torque sensor where the sensing object 1 (shaft) is symmetrically shaped as, most likely, the shaft will rotate when used in the targeted application. No mechanical changes need to be made to the shaft in whatever way. Mechanically the shaft design (sensing object) remains unchanged. Nothing needs to be attached to the sensor object (shaft) in whatever way, no mechanical changes need to be made to the sensor object in whatever way, the sensor object does not have to be coated in whatever way. The actual used axial length for the inventive magnetic shaft processing can have any "practical" length, ranging from a very few mm (millimeters) to the length of the entire shaft. Typically the sensor system length may range between 10 mm and 25 mm. For example, the sensor object is a solid shaft.

To detect and to measure the changes of the absolute magnetic field that is emanating from the sensor object a "Magnetic Sensor Module" (MSM) needs to be placed in the area where the magnetic flux lines are still effective. When not using any compensation techniques, the distance between the MSM and the sensor object has to be kept as constant as possible. Allowing the MSM to change its position in relation to the sensor object may cause variations in the measured signal amplitude.

The sensor electronics needed to convert the signals coming from the MSM in the desired output signal format can be placed almost anywhere as long as the environmental conditions will not exceed what the electronics has been designed for. The sensor electronics can be placed inside the frame (housing) of the MMS, or can be placed in its own housing away from the MSM. Some of the reasons for the sensor electronics to be placed away from the MSM may be the operational temperature for the electronics is too high, the mechanical shocks and vibrations exceed what the ICs can cope with, or there is no space in the MSM (limited spacing available). However, there may be a limit about how far the sensor electronics can be placed away from the MSM source signal (max cable length, signal-to-noise ratio, max allowed impedance, . . . ). The output signal of the sensor electronics can have any desired format, ranging from pure analogue to serial digital protocols. The "basic" sensor electronics (without any digital processing) requires very little electrical power, like less than 10 mA for example.

When using an electronic circuit to measure a static magnetic field, which is based on a flux-gate principle, then the output signal will be a fixed frequency with a changing pulse-width-ratio. The flux-gate circuit operates with an inductor as the actual magnetic field sensing device. The pulse-width-ration (PWR) will be 50-50 when not static magnetic field is present. But as we have almost always the earth-magnetic field in the background, the PWR may have shifted a bit. Depending on the signal gain of the electronic system the PWR may be then 51-49 for example or 55-45 for a positive magnetic field. When turning around the sensing inductor by 180 deg then the earth-magnetic field will come from the other direction and the resulting PWR may be like this: 45-55, for example.

Figure 2:
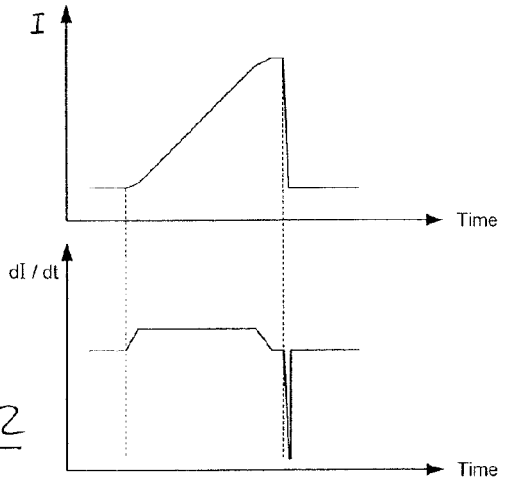
FIG. 2 illustrates schematically amounts and the polarity of current and the dI/dt values according to an exemplary embodiment of the invention.

FIG. 2 illustrates schematically amounts and the polarity of current and the dI/dt values according to an exemplary embodiment of the invention. The first manufacturing process step for this non-contact, magnetic principle based torque sensor is to apply a strong, circumferential oriented magnetic field onto a symmetrically shaped test object (shaft). This processing step results eliminates the need of having to degauss the test object (shaft) prior to the magnetic encoding process. To achieve this (the value dI/dt is kept constant) an continuously increasing level of electric current will be conducted through the test object at the desired sensor location until it reaches a pre-programmed maximum value.

In comparison to other alternative magnetic processing technologies (like those used by MDI, ABAS, NCTE, for example), the here required electrical current is much lower (less than halve, in some cases even less than one quarter). The behavior of the sensor object during the raising-phase of the electric current can be monitored in real time (Real-Time Processing Diagnostics=RTPD). The measurement results of the RTDP (Real Time Processing Diagnostics) are used to determine by when (in time) the constant current increase (dI/dt) will be stopped in order to achieve repeatable sensor performances. When working with test-objects that have a relative small diameter (below 10 mm) the maximum current level that should be used has to be reduced drastically as otherwise the sensor magnetization will not take place as desired.

The amounts and the polarity of the dI/dt values are the important processing parameters that are responsible for the permanent magnetisation of the sensing object and the achievable sensor performance.

To achieve the electric signal pulse shape needed (dI/dt) several different processing system designs have been built and tested with somewhat similar results, namely using large capacities for electric energy storage, very heavy and expensive equipment, using large inductors, extremely good test results for the least amount of electronic equipment needed, using large and fast responding batteries, requires very powerful and expensive batteries.

Figure 3:
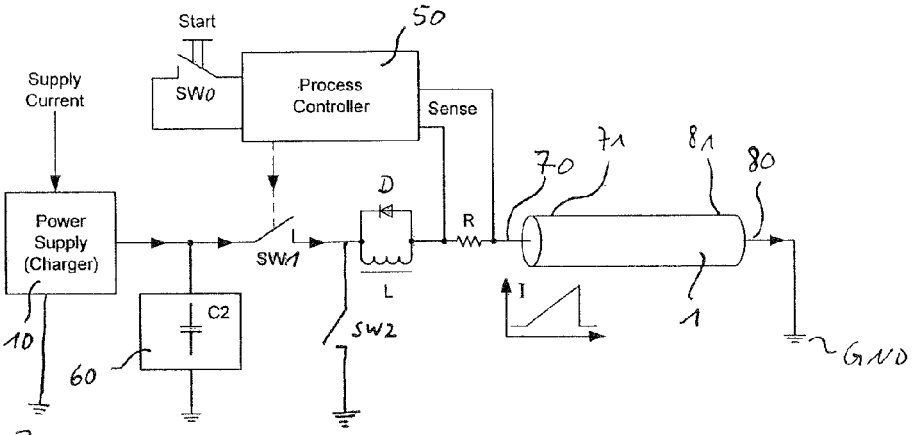
FIG. 3 illustrates a device having a process controller module according to an exemplary embodiment of the invention.

FIG. 3 illustrates a device having a process controller module according to an exemplary embodiment of the invention. In comparison to the processing equipment shown in FIG. 4 ("using large capacitive storage capacitors"), the solution of FIG. 3 (using a large inductor with metallic core) is much smaller and up to factor four lighter in weight. The module "Process Controller" 50 is a timer that is activated by the "Start" switch SW0. The Inductor "L" has to be large enough to store the energy required for the magnetic processing of the sensor object (in this example the "transmission shaft"). The actual value of "L" is subject to the physical dimensions of the sensor object 1 and the targeted torque sensor performances. The processing parameters can be adjusted by changing the following values:

Charger supply voltage
Actual storage capacity value of C2, 60
Timing sequence of the Process Controller 50
Actual value of the Inductor L
Process Control Resistor R There are alternative ways about how the "Fly-back" diode D will connected. In the here shown design the diode D protects only the processing equipment. With other designs of the "fly-back" diode the energy released by the inductor L can be harness and used for the actual sensor object processing. The process controller 50 may control the switch SW1. The entire system will be provided with energy by a power supply 10. The object 1 can be connected to the device by a first electrode 70 and a second electrode 80. The electrodes 70 and 80 may be connected to respective contacting sections 71 and 81 of the object 1. The process controller 50 may monitor the process by measuring the current, e.g. by using a resistivity R ore the resistivity of the object 1 as a shunt.

Figure 4:
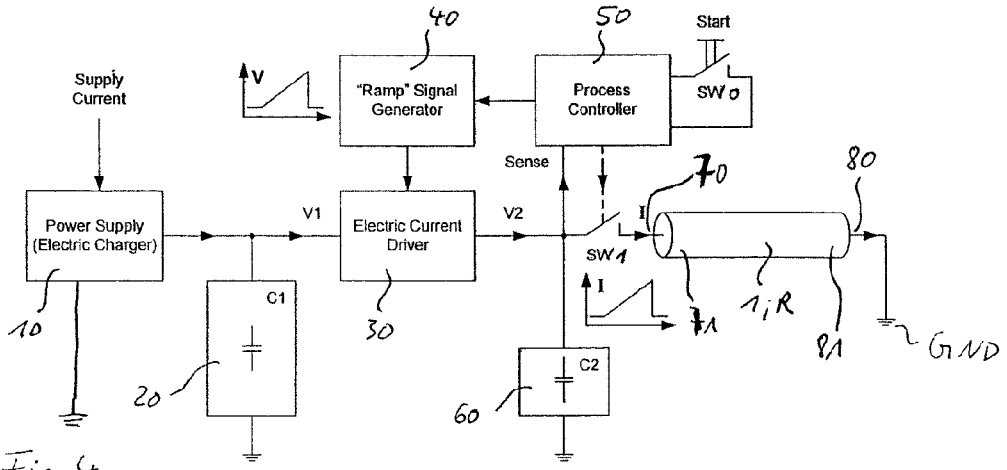
FIG. 4 illustrates a device having an electric processing module with an electric current driver according to an exemplary embodiment of the invention.

FIG. 4 illustrates a device having an electric processing module with an electric current driver 30 according to an exemplary embodiment of the invention. The electric current signal for processing the sensing object will be generated by a ramp signal generator 40. An efficient and powerful electric current driver 30 is then creating the current ramp profile by charging the capacitor C2, 60. The switch SW1 ensures that the "processing" of the sensing object stops at the desired time and prevents any unwanted parasitic effects are caused by the remaining electric energy in the capacitor C2, 60. The "optimal" electric processing signal "I" will be enforced by the module "Electric Current Driver" 30 and the switch SW1. The solution shown above requires large (in size and in value) electric energy storage capacities (C1, 20 and C2, 60), although C2, 60 may have to have only halve storage capacity in comparison to C1, 20. The entire procedure may be started by switch SW0. The process controller 50 may control the switch SW1 as well as the ramp signal generator 40. The entire system will be provided with energy by a power supply 10, The object 1 can be connected to the device by a first electrode 70 and a second electrode 80. The electrodes 70 and 80 may be connected to respective contacting sections 71 and 81 of the object 1. Although not shown, the process controller may monitor the process by measuring the current, e.g. by using the resistivity of the object 1 as a shunt.

Figure 5:
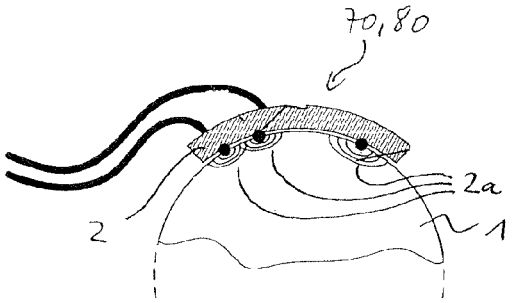
FIG. 5 illustrates electric contact priming according to an exemplary embodiment of the invention.
Figure 5:
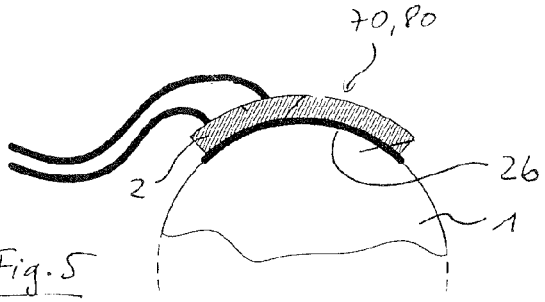

FIG. 5 illustrates electric contact priming according to an exemplary embodiment of the invention. As the electric current is rising slowly and steadily till it reaches the desired current levels, the electric contacts 2 of the electrodes 70, 80 used to pass-on the current "into" and "out" of the sensor object 1 (like a shaft) the actual connection points 2*a* (between the contacts 2 and the sensor object surface) is getting primed, as can be seen from contacts 2*b*. This means that an almost perfect and very uniform, low impedance connection 2*b* forms all the way around the contact areas 71, 81. This is one major reason that the magnetic field generated by the processing method is very uniform and no other post-processing step is needed. When dI/dt becomes to large (fast raising electric current at the raising slope of the processing signal) then "point" shaped contact location form 2*a* caused by spankings.

In case the raising slope of the electric current (passed through the sensor object) would be very sudden and very large, then the electric current will pass through very few locations 2*a* from the electric contacts through the object surface. Sparks will form and these electric sparks will cause major magnetic disturbances in the sensor object surfaces. The result is a relative large "magnetic non-uniformity" of the embedded magnetic signature. This will cause changes in signal gain and changes in the signal offset when picking-up the torque related signal from different locations at the sensor object. Uniform magnetic field formation in the sensor object when "Priming" the contact area first by ensuring that dI/dt is a relive small value.

Figure 6:
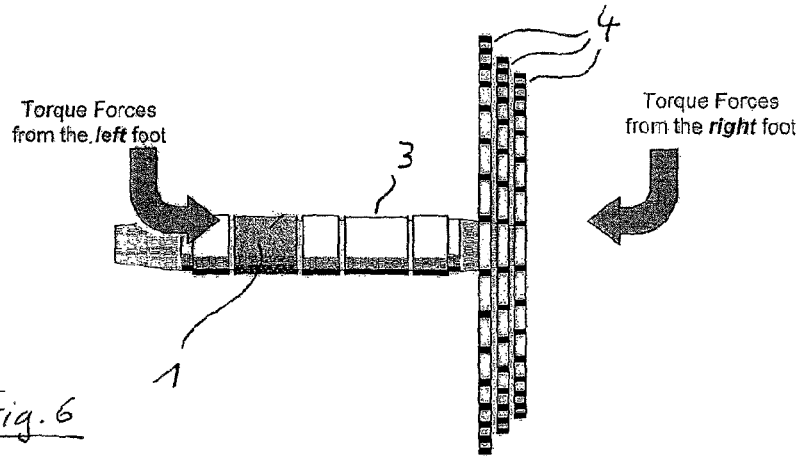
FIG. 6 illustrates a bike or e-bike torque sensor according to an exemplary embodiment of the invention.

FIG. 6 illustrates a bike or e-bike torque sensor according to an exemplary embodiment of the invention. In this example the sensing object 1 is a part of the main drive shaft 3 of a standard or electrically powered bicycle, being connected to one or more gear wheels 4. Somewhere along the stretch between the left and the right paddle, the main drive shaft has been permanently magnetized by the inventive torque sensing technology. Note, that this specific design solution allows measuring the torque forces coming from one bicycle pedal only.

Figure 7:
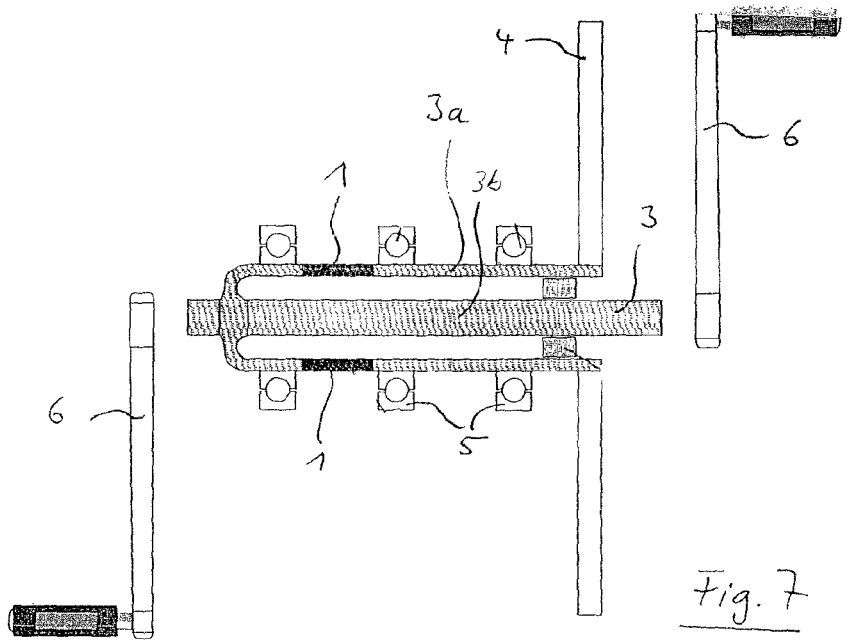
FIG. 7 illustrates a tubal drive shaft design according to an exemplary embodiment of the invention.

FIG. 7 illustrates a tubal drive shaft design according to an exemplary embodiment of the invention. This "tubal" drive shaft design allows measuring the torque forces generated by both bicycle pedals 6 (left-foot and right-foot pedal). The object 1 is located with respect to the entire drive shaft 3 so that torque from both pedals 6 can be determined. Torque from the left pedal will be transmitted to the gear wheel 4 via the tubular section 3*a* only, wherein torque from the right pedal 6 will be transmitted via the central section 3*b* of the shaft 3. Bearings 5 will keep the arrangement in a fixed frame.

Figure 8:
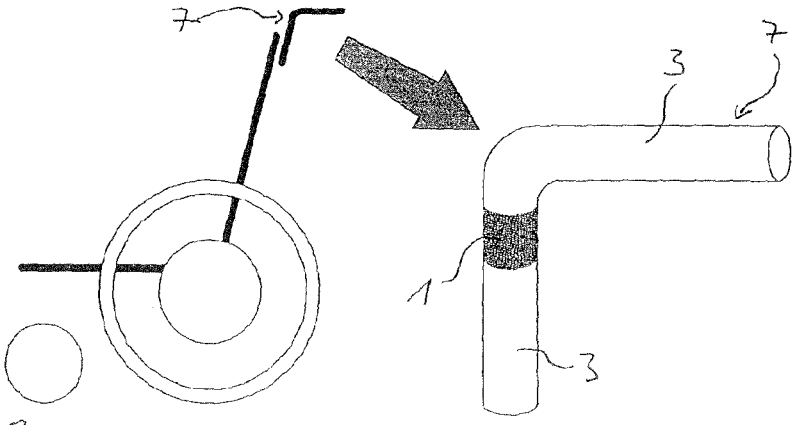
FIG. 8 illustrates a wheel chair according to an exemplary embodiment of the invention.

FIG. 8 illustrates a wheel chair according to an exemplary embodiment of the invention. The inventive torque sensor allows building a cost effective and weather proof mechanical force sensor to measure the mechanical forces, applied by the person that is pushing a wheel chair, in order to steer the wheel chair. The measured torque signal will then be used to control the power in the two electric motors (left wheel, right wheel) that propel the wheel chair. For this purpose, the object 1 may be provided in the force transmission arrangement 3, which may be provided in the handle 7 of the wheel chair.

The inventive torque sensing technology allows the market to use torque sensors in applications where cost has been always a critical issue and where the harsh operating conditions prevented the use of alternative sensing solutions. Below is a list and some descriptions of a few of so many application the inventive sensor will be used in the future.

| Market Segment | Applications | Key Feature |
|---|---|---|
| Automotive | Brake Systems | Optimising traction when braking |
| | Front/Rear Steering System | Significantly reducing over/under steering |
| | Engine Management | CO2 reduction in city traffic |
| | Hybrid Management | fuel reduction, increased comfort |
| | Traction Control | Full functionality on ice and at low speed |
| Trucks | Gearboxes | Weight & Cost Reduction |
| | Brake System | Optimising traction when braking |
| Motor Bikes | Brake Control | Reduction of brake distance |
| | Traction Control | Increased safety (no flip-over), max traction |
| Rail Road (Trains) | Brake Systems | \brake distance reduction |
| | Gearbox Efficiency | Weight and cost reduction |
| Water Sport (Yachts) | Transmission Control | >40% fuel reduction, double range |
| Naval | Performance testing, inspections | Significant cost reduction |
| Avionics | Gas Turbine Engines | Fuel reduction |
| | Gas Turbine Engines | Increase of safety |
| | Flap Control | Reduction of failures, optimise maintenances |
| | Assembly equipment | Increase of safety and tools performance |
| Wind Power: | Gearboxes | 50% reduction of costly failures |
| | Blades Fixture | >25% reduction of blade damages |
| | Main Shaft & Gearbox | Reduction of weight (~2 tons) |
| Truck Test Systems | Calibration & Test Equipment | Significant weight & cost reduction |
| Motor Sport | Transmission control | Shortening lab time by 2 seconds |
| | Wheel mounting (Fastening Tools) | 0.5 second time reduction |
| Medical Equipment | Wheel Chair Control | Prolongs mobility by 15% |
| | Steering assistant | 50% cost reduction, increase reliability |
| Consumer Goods | E-Bikes | needs no space, lowest cost, accurate |

An inventive device and a corresponding method is distributed by PolyResearch under the trade mark 'Einstein'.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

REFERENCE LIST

1 magnetized object/object to be magnetized
2 contact pads
2*a* discrete contacting points
2*b* wide contacting area
3 transmission shaft
3*a* tubular section of transmission shaft

3*b* rod section of transmission shaft
4 gear wheel
5 bearings
6 pedal
7 handle
10 power supply
20 energy storing capacity
30 electric current driver
40 ramp signal generator
50 process controller
60 energy storing capacity
70 first electrode
71 first contacting section of the object 1
80 second electrode
81 second contacting section of the object 1
C1, C2 capacities
D diode
GND ground potential
I current
L inductance
R resistor
SW0 starting switch
SW1, SW2 current forming switches
V1, V2 voltage

The invention claimed is:

1. A device for magnetizing an object, comprising:
a first electrode and a second electrode contacting the object; and
a current generator configured to apply a current having a rising current slope and a falling current slope, the falling current slope being steeper than the rising current slope,
wherein the current generator is configured to apply the current such that a time period of the rising slope is more than 1000 times longer than a time period of the falling slope, and the current generator includes:
a current supply including first and second terminals;
a first switch including first and second terminals;
an inductance including first and second terminals;
a resistance including first and second terminals; and
a switch control;
wherein the first terminal of the current supply is connected to the second electrode, the second terminal of the current supply being connected to the first terminal of the first switch, the second terminal of the first switch being connected to the first terminal of the inductance, the second terminal of the inductance being connected to the first terminal of the resistance, the second terminal of the resistance being connected to the first electrode, and
wherein the switch control is configured to close the first switch for starting a rising current slope.

2. The device according to claim 1, wherein the second electrode is connected to ground (GND).

3. The device according to claim 1, wherein the resistance operates as a shunt, the shunt providing a measurement signal to the switch control, the measurement signal serving as a base for controlling the first switch.

4. The device according to claim 1, further comprising:
a second switch including first and second terminals,
wherein the first terminal of the second switch is connected to a branch between the second terminal of the first switch and the first electrode and the second terminal of the second switch is connected to the second electrode, and
wherein the switch control is configured to close the second switch when opening the second switch at an end of the rising current slope.

5. The device according to claim 1, further comprising:
a charging capacity including first and second terminals,
wherein the first terminal of the charging capacity is connected to the first terminal of the first switch and the second terminal of the charging capacity is connected to the second electrode.

6. A method for magnetizing an object to be magnetized, comprising:
applying a magnetizing current from a first electrode having a first section of the object to a second electrode having a second section of the object using a device according to claim 1,
wherein the second section is remote from the first section,
wherein the magnetizing current has a rising slope and a successive falling slope,
wherein the falling slope is steeper than the rising slope, and
wherein a time period of the rising slope is more than 1000 times longer than a time period of the falling slope.

7. The method according to claim 6, wherein the rising slope is of a substantially linear gradient.

8. The method according to claim 6, wherein the rising slope starts from substantially zero and substantially rises linearly, the falling slope immediately succeeding and ending at substantially zero.

9. The method according to claim 6, wherein the rising slope is positive and the falling slope is negative.

10. The method according to claim 6, wherein the applying step includes the substep of electrically contacting the respective electrode to the object.

11. A device for magnetizing an object, comprising:
a first electrode and a second electrode contacting the object; and
a current generator configured to apply a current having a rising current slope and a falling current slope, the falling current slope being steeper than the rising current slope,
wherein the current generator is configured to apply the current such that a time period of the rising slope is more than 1000 times longer than a time period of the falling slope, and the current generator includes:
a current supply including first and second terminals;
a first switch including first and second terminals;
an inductance including first and second terminals; and
a switch control,
wherein the first terminal of the current supply is connected to the second electrode, the second terminal of the current supply being connected to the first terminal of the first switch, the second terminal of the first switch being connected to the first terminal of the inductance, the second terminal of the inductance being connected to the first electrode,
wherein the object operates as a resistance when being connected to the first and second electrodes, and
wherein the switch control is configured to close the first switch for starting a rising current slope.

* * * * *